United States Patent [19]

Kitchen

[11] 4,131,961

[45] Jan. 2, 1979

[54] FORMED WIRE BOX SPRING WITH WIRE GRID UNIT

[75] Inventor: John P. Kitchen, Georgetown, Ky.

[73] Assignee: Hoover Universal, Inc., Saline, Mich.

[21] Appl. No.: 824,340

[22] Filed: Aug. 15, 1977

[51] Int. Cl.[2] ..... A47C 23/05

[52] U.S. Cl. ..... 5/247; 5/254

[58] Field of Search ..... 5/246, 247, 248, 253, 5/254, 261, 255, 260, 267, 351, 275, 276

[56] References Cited

U.S. PATENT DOCUMENTS

| | | | |
|---|---|---|---|
| 3,574,240 | 4/1971 | Slominski | 5/247 |
| 3,833,948 | 9/1974 | Surletta et al. | 5/247 |
| 4,000,531 | 1/1977 | Inman | 5/351 |
| 4,012,801 | 3/1977 | King et al. | 5/247 |

*Primary Examiner*—Kenneth J. Dorner

*Attorney, Agent, or Firm*—Olsen and Stephenson

[57] ABSTRACT

A wire grid unit cooperating with a box spring assembly to support a mattress. The box spring assembly has a mattress support framework defined by spaced apart longitudinally and transversely extending main springs having generally straight body portions. The grid unit, which consists of a plurality of generally straight wire members secured to each other in criss-cross fashion, is supported on the mattress support framework so that some of the grid wire members extend midway between adjacent pairs of transversely extending spring body portions and other grid wire members extend midway between adjacent pairs of longitudinally extending spring body portions.

5 Claims, 4 Drawing Figures

FORMED WIRE BOX SPRING WITH WIRE GRID UNIT

BACKGROUND OF THE INVENTION

The present invention relates generally to box spring assemblies, and more particularly, to an improved box spring assembly in which a uniformly distributed resistance to bedding loads is obtained.

In box spring assemblies of the type such as is disclosed in U.S. Pat. No. 3,574,240, a horizontal mattress support framework is provided in a box spring assembly. The framework is defined by a plurality of spaced apart main wire springs, some of which extend longitudinally of the assembly and others of which extend transversely of the assembly. The wire springs are thus arranged in a criss-cross fashion forming rectangular spaces between adjacent longitudinally and transversely extending wire springs. The box spring assembly also includes a plurality of intermediate support springs, each of which includes a generally straight body portion and depending end portions. Each body portion of an intermediate support spring extends diagonally between adjacent springs thereby diagonally bisecting a rectangular space. It is desirable, however, to reduce the sizes of the other rectangular areas which are not bisected by the intermediate support springs so as to further increase the surface area of support for a mattress. It is also desirable to decrease the sizes of these rectangular areas in such a manner so as not to require a change in the basic construction of the box spring assembly.

It is the object of the present invention, therefore, to provide a grid unit which cooperates with the mattress support framework of the box spring assembly to provide improved and more uniformly distributed support for a mattress.

SUMMARY OF THE INVENTION

In accordance with the present invention, a grid unit is provided for easy mounting of a formed wire box spring assembly to increase the load bearing area for a mattress. The conventional box spring assembly as disclosed in U.S. Pat. No. 3,574,240, consists of a generally rectangular frame on which wire springs are mounted. The wire springs include generally straight main body portions and depending end portions constructed to deflect under load. The springs are mounted on the frame in a criss-cross fashion in which the body portions of some of the wire springs extend longitudinally of the frame and the body portions of other wire springs extend transversely of the frame. Adjacent longitudinally and transversely extending wire springs are spaced apart so as to define rectangular spaces.

The box spring assembly further includes intermediate support springs which are mounted on cross rails extending across the frame. The intermediate support springs also include generally straight body portions that are positioned diagonally between adjacent pairs of springs to bisect the corresponding rectangular space. Accordingly, the main and intermediate springs define a mattress support framework having a number of open rectangular spaces and thus offer support to a mattress positioned on the box spring assembly which is not entirely satisfactory.

The grid unit of this invention comprises a plurality of generally straight wire members arranged in a criss-cross fashion to form a generally rectangular structure having rectangular spaces defined by the criss-crossed wire members. The grid unit is supported on the mattress supporting surface of the box spring assembly so that some of the wire members extend transversely of the box spring assembly so that some of the wire members extend transversely of the box spring assembly midway between adjacent wire springs that extend transversely of the frame to bisect some of the rectangular spaces. Other wire members are located to extend longitudinally of the frame between adjacent wire springs that extend longitudinally of the frame to bisect other rectangular spaces. The grid unit is configured and dimensioned so that rectangular spaces having the intermediate support springs are not bisected by the wire members of the grid unit. Therefore, only the open rectangular spaces which lack intermediate support springs are bisected by the wire members of the grid unit.

Thus, the box spring with wire grid unit of this invention provides an improved mattress support thereby promoting comfort and increasing the useful life of the mattress.

Further objects, features and advantages of the present invention will become apparent from a consideration of the following description when taken in connection with the appended claims and the accompanying drawing in which:

Figure 1:
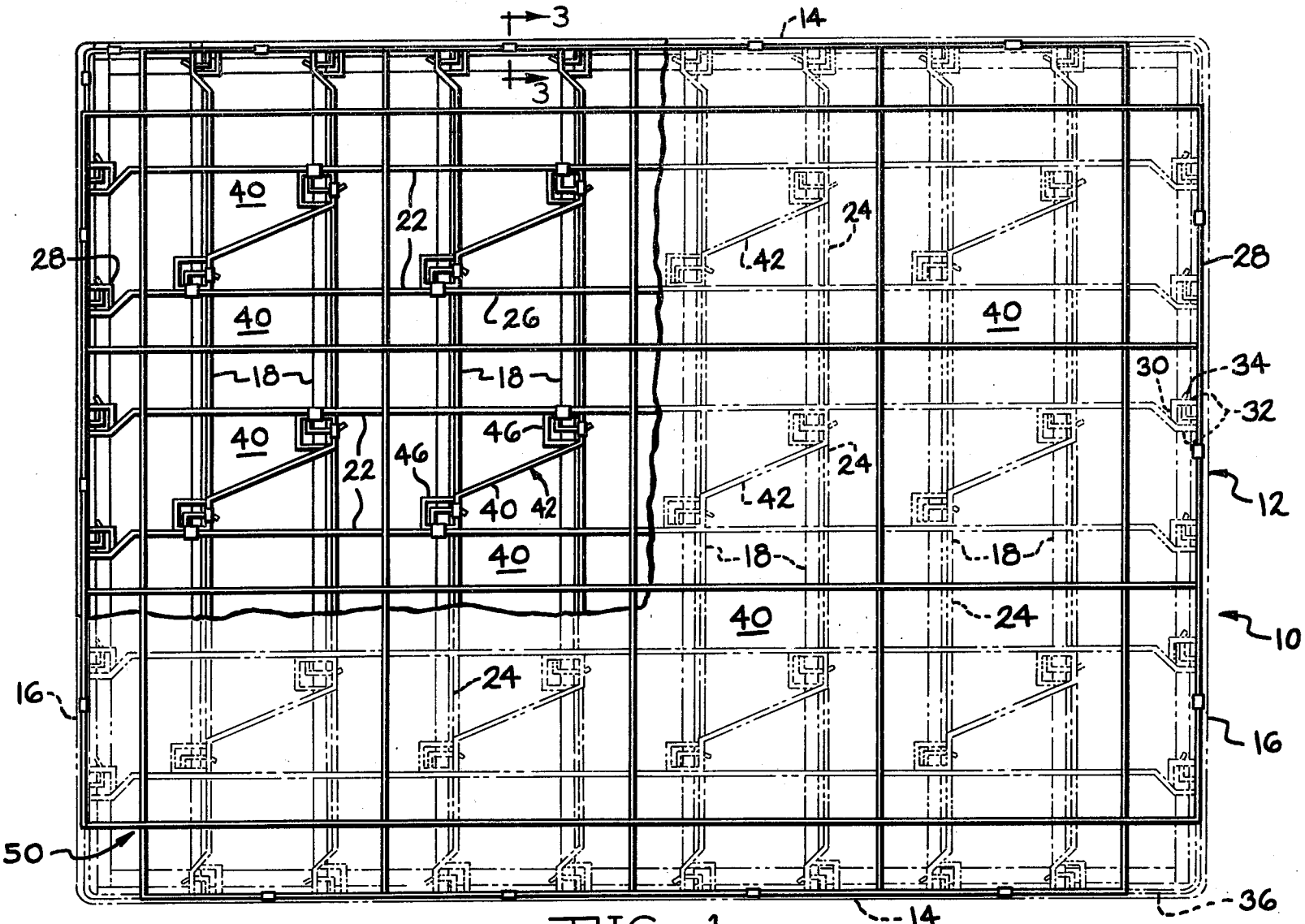
FIG. 1 is a plan view of the box spring assembly with grid unit of this invention supported thereon with some parts shown in broken lines to better illustrate the grid unit.

With reference to the drawing, the box spring assembly in this invention, indicated generally at 10, is illustrated in FIG. 1 as comprising a generally rectangular main frame 12 which is horizontally disposed and has side rails 14 and end rails 16 that are substantially perpendicular to the side rails 14. A plurality of cross rails 18 extend transversely across the frame 12 and are supported on the side rails 16 in horizontally spaced apart positions parallel with the end rails 14.

A plurality of main wire springs 22 are mounted in horizontally spaced apart positions on the frame 12 and extend longitudinally of the frame 12. A plurality of main wire springs 24 are mounted in horizontally spaced apart positions on the frame 12 and extend transversely of the frame 12. The wire springs 22 and 24 are arranged in a criss-cross fashion on the frame 12 to form a portion of a generally horizontal mattress support surface. Each main wire spring 22 and 24 includes a generally straight main body portion 26 and depending end portions 28 which are supported by the frame 12. The end portions 28 are shown as being formed to a generally fish-mouth configuration and are described in detail in U.S. Pat. No. 3,574,240. The end portions 28 comprise yieldable formed wire portions consisting of alternatively arranged torsion bars 30 and inclined connecting bars 32 and terminate at the lower ends in a foot 34 mounted on the frame 12. A border wire 36, located above the frame 12, is positioned at the perimeter of the frame 12 defined by the end rails 14 and the side rails 16 and conforms to the rectangular shape of the frame 12. The border wire 36 is secured to the main springs 22 and 24 by wrap-around clips (not shown) which encircle the border wire 36 and selected portions of end portions 28 of the wire springs 22 and 24.

The generally straight body portions 26 of the main wire springs 22 and 24 are located above the frame 12 in a generally horizontal plane which defines the mattress support framework. The criss-cross arrangement of the main wire springs 22 and 24 forms generally rectangular spaces 40 between adjacent pairs of the springs 22 and 24. Rectangular areas 40 are also defined by the border wire 36 and the adjacent wire springs 22 and 24.

Intermediate support members or springs 42 are mounted on the cross rails 18 and are each provided with a generally straight body portion 44 and depending end portions 46. The intermediate support springs 42 are each oriented on the cross-rails 18 so that the body portion 44 extends diagonally between a pair of adjacent longitudinal main springs 22 and also between a pair of transversely extending main springs 24 thereby diagonally bisecting a rectangular area 40. The body portions 44 of the intermediate springs 42 are located in the horizontal plane defining the mattress support surface and cooperate with the springs 22 and 24 to support a mattress.

Figure 2:
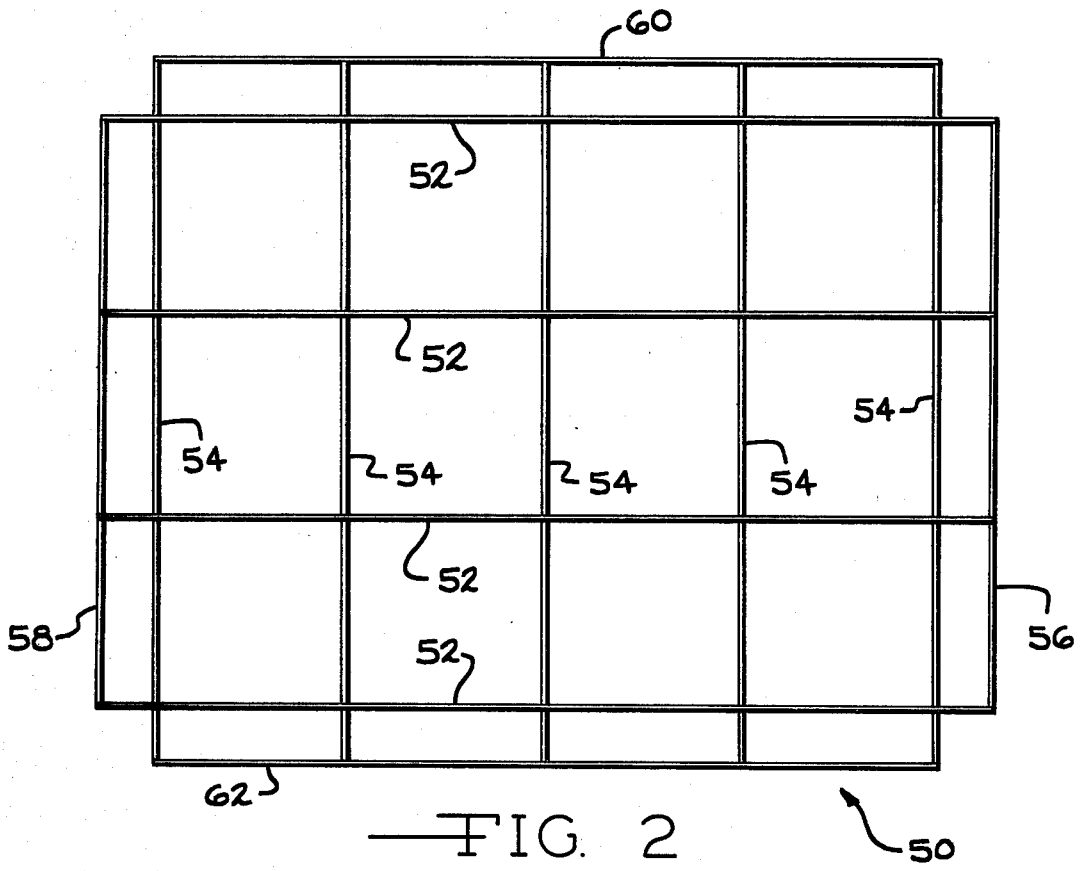
FIG. 2 is a plan view of the grid unit of this invention.

This invention includes a grid unit 50, shown positioned on the box spring assembly 10 in FIG. 1, and shown in a plan view in FIG. 2. The grid unit 50 comprises a plurality of generally straight wire members 52 and 54 arranged so that the wire members 52 which are generally parallel with each other are substantially perpendicular to the wire members 54 which are also generally parallel with each other. The criss-crossed wire members 52 and 54 are suitably secured together such as by welding to form the grid unit 50. The opposite ends of the wires 52 are connected together by end wire members 56 and 58, respectively, and the opposite ends of the wires 54 are connected together by end wire members 60 and 62, respectively. As can be seen in FIG. 2, the end members 56 and 58 are generally parallel to the wire members 54 and are located from their respective adjacent wire members 54 distances that are less than the distance between adjacent wire members 54. Similarly, the end members 60 and 62 are generally parallel to the wire members 52 and are located from their respective wire members 52 distances that are less than the distance between adjacent wire members 52.

The grid unit 50 is dimensioned to a generally rectangular shape so that its perimeter defined by the wire members 56, 58, 60 and 62 corresponds to the perimeter of the box spring assembly 10 defined by the border wire 36. The wires 52 and 54 are oriented in the grid unit 50 so that when the unit 50 is placed on the mattress support surface of the box spring assembly 10 the wires 52 extend longitudinally of the frame 12 midway between adjacent longitudinally extending wire springs 22 but only between the wire springs 22 wherein provision for intermediate spring 42 has not been made. The wire members 54 extend transversely of the frame 12 midway between adjacent transversely extending wire springs 24 wherein provision for intermediate springs 42 has not been made. The outermost wire members 52 and 54 are positioned to extend midway between the wire borders 36 and the main springs 22 and 24 to bisect the rectangular areas 40 which are located along the perimeter of the assembly 10. The grid unit 50 is then secured to the box spring assembly 10 by wrap-around clips 64 which secure the end members 56 - 62 to the border 36 as viewed in FIGS. 1 and 3.

As can be seen, all rectangular areas 40 which are not bisected by the intermediate support springs 42 are now bisected by either the wire members 52 or the wire 54 of the grid unit 50. Moreover, those rectangular areas 40 in which the wire members 52 and 54 intersect are quadrisected. Accordingly, all of the rectangular areas 40 are at least bisected with a plurality of the areas 40 being quadrisected to thereby increase the load supporting surfaces for a mattress.

Figure 3:
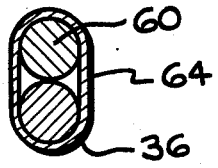
FIG. 3 is an enlarged sectional view of the grid unit and box spring assembly taken substantially along the line 3—3 in FIG. 1.
Figure 3A:
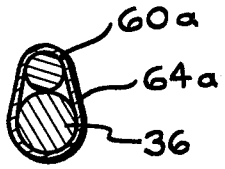
FIG. 3A is a sectional view like FIG. 3 illustrating a grid unit having wire members of smaller diameter than the diameter of the main wire springs in the box spring assembly.

FIG. 3A illustrates a modified construction of the grid unit 50 wherein the diameter of the wire members are represented by the end wire member 60A have a diameter that is less than the diameter of the border wire 36 and the main springs 22 and 24. The wrap-around clips 64A are therefore modified so as to accommodate this size difference and snugly secure the grid unit 50 to the border wire 36. The upper portion of the clip 64A has a radial curvature that is less than the radial curvature of the lower portion so as to conform to the circumferential configuration of the wire member 60A. The wire clip 64 as shown in FIG. 3 has its upper and lower portions formed with radial curvatures that are substantially equal to accommodate the wire members 60 and 36 which have generally equal diameters.

As can be seen from the above description, the grid unit 50 of this invention cooperates with the mattress support surface of the box spring assembly to provide added support for a mattress supported by the box spring. The grid unit 50 is easily and inexpensively fabricated, and is easily installed on the box spring assembly 10 without requiring any change in the construction of the box spring assembly 10.

What is claimed:

1. In a box spring assembly which includes a horizontal main frame of generally rectangular shape having longitudinal and transverse dimensions and side and end rails, a plurality of main wire springs mounted on said main frame, each of said main springs having a generally horizontal body portion and depending end portions, said spring end portions being supported on horizontally spaced portions of said rails so that some of said spring body portions extend longitudinally and others transversely of said frame and said body portions are arranged criss-cross fashion in a substantially horizontal plane disposed above said frame thereby forming a mattress support framework in said plane having rectangular spaces formed in the rectangular areas between adjacent pairs of adjacent transverse and longitudinal body portions; the improvement comprising a wire grid unit supported on said mattress support framework so as to reduce the effective sizes of at least some of said spaces, said grid unit comprising a plurality of generally straight wire members arranged criss-cross fashion and secured to each other, said unit being supported on said mattress support framework so that some of said grid members extend transversely of said frame substantially midway between adjacent pairs of transversely extending spring body portions and others of said grid members extend longitudinally of said frame substantially midway between adjacent pairs of longitudinally extending spring body portions to thereby cut in half the sizes of the spaces between said adjacent body portions.

2. A box spring assembly according to claim 1 wherein said assembly further includes internal support springs connected to and extending between adjacent pairs of body portions so as to substantially bisect some of said spaces, and wherein said grid members are positioned so that they substantially bisect substantially all of the spaces not bisected by said internal support springs.

3. A box spring assembly according to claim 1 wherein said grid wire members and said main springs are of substantially the same diameter.

4. A box spring assembly according to claim 1 wherein said grid wire members are of a smaller diameter than said main wire springs.

5. The box spring assembly according to claim 1 wherein the longitudinal and transverse spacing of the straight wire members in said grid unit is substantially twice the longitudinal and transverse dimensions of said rectangular spaces so that alternate ones of said spaces are bisected by said straight wire members.

* * * * *